US011542458B2

(12) United States Patent
Valdepena et al.

(10) Patent No.: US 11,542,458 B2
(45) Date of Patent: Jan. 3, 2023

(54) FABRIC CONDITIONERS

(71) Applicant: Colgate-Palmolive Company, New York, NY (US)

(72) Inventors: Israel Hernandez Valdepena, Mexico D. F. (MX); Raul Arellano Maldonado, Mexico D.F. (MX); Jose Javier Tovar Pescador, Mexico D.F. (MX)

(73) Assignee: Colgate-Palmolive Company, New York, NY (US)

( * ) Notice: Subject to any disclaimer, the term of this patent is extended or adjusted under 35 U.S.C. 154(b) by 306 days.

(21) Appl. No.: 16/065,334

(22) PCT Filed: Dec. 28, 2015

(86) PCT No.: PCT/US2015/067686
§ 371 (c)(1),
(2) Date: Jun. 22, 2018

(87) PCT Pub. No.: WO2017/116397
PCT Pub. Date: Jul. 6, 2017

(65) Prior Publication Data
US 2020/0385652 A1 Dec. 10, 2020

(51) Int. Cl.
*C11D 3/37* (2006.01)
*C11D 3/00* (2006.01)
*C11D 17/00* (2006.01)

(52) U.S. Cl.
CPC ..... *C11D 3/0015* (2013.01); *C11D 3/3742* (2013.01); *C11D 17/0017* (2013.01)

(58) Field of Classification Search
CPC ..... C11D 3/3742; C11D 1/62; C11D 3/001; C11D 3/0015; C11D 3/18; C11D 3/2093
See application file for complete search history.

(56) References Cited

U.S. PATENT DOCUMENTS

| | | | | |
|---|---|---|---|---|
| 3,402,191 | A | 9/1968 | Morehouse | |
| 5,000,861 | A | 3/1991 | Yang | |
| 5,346,642 | A | 9/1994 | Patel et al. | |
| 5,474,835 | A | 12/1995 | McCarthy et al. | |
| 5,573,694 | A | 11/1996 | Danner | |
| 6,362,142 | B1 * | 3/2002 | Weber | A61K 8/416 510/119 |
| 6,942,818 | B2 | 9/2005 | Chrobaczek et al. | |
| 9,783,764 | B2 | 10/2017 | Leon Navarro et al. | |
| 2005/0124528 | A1 * | 6/2005 | Binder | C11D 3/3765 510/475 |
| 2011/0027206 | A1 * | 2/2011 | O'Lenick, Jr. | C08G 77/388 424/65 |
| 2011/0269657 | A1 * | 11/2011 | Dihora | C11D 3/001 510/119 |
| 2014/0189962 | A1 * | 7/2014 | Tovar Pescador | C11D 3/2086 8/137 |
| 2015/0030557 | A1 * | 1/2015 | Gizaw | A61K 8/898 424/70.122 |
| 2015/0337240 | A1 * | 11/2015 | Leon Navarro | C11D 3/001 510/515 |
| 2016/0024436 | A1 * | 1/2016 | Vetter | C11D 3/162 510/528 |

FOREIGN PATENT DOCUMENTS

| | | | |
|---|---|---|---|
| CN | 1051599 | A | 5/1991 |
| CN | 1378587 | A | 11/2002 |
| CN | 101680158 | B | 3/2010 |
| CN | 102186963 | B | 9/2011 |
| CN | 103748204 | B | 4/2014 |
| CN | 104854227 | | 8/2015 |
| CN | 104854228 | | 8/2015 |
| CN | 105164243 | | 12/2015 |
| GB | 2201433 | | 9/1988 |
| WO | 2009/127590 | | 10/2009 |
| WO | 2012/003192 | | 1/2012 |

OTHER PUBLICATIONS

International Search Report and Written Opinion of the International Searching Authority in International Application No. PCT/US2015/067686, dated Sep. 15, 2016.
Compilation of Paraffin Information Materials, Paraffin Technology Information Station of China Petrochemical Corporation, published Dec. 1995, p. 32, corresponding to p. 25 of version published Dec. 1993.
Falbe, "Surfactants in Consumer Products—Theory, Technology and Application," Translated by Zhang et al., China Petrochemical Press, Jul. 1994, p. 338.

* cited by examiner

*Primary Examiner* — John R Hardee

(57) ABSTRACT

Described herein, are in-wash fabric conditioning compositions, comprising: from about 0.5 to about 40 wt % of an aminopolysiloxane; and water, wherein the aminopolysiloxane and water are present in the form of an emulsion. In-wash fabric conditioning compositions comprising an emulsion comprising from about 0.1 to about 5 wt % of an aminopolysiloxane, based upon the total weight of the in-wash fabric conditioning composition, wherein the aminopolysiloxane comprises amino substituted alkyl moieties, an effective amount of a solvent, and a synthetic wax, are also disclosed. Methods of making and using these compositions are also described.

7 Claims, No Drawings

FABRIC CONDITIONERS

BACKGROUND

A conventional laundry cycle tends to wear down fabrics and garments over time due to the agitation of the washing and drying cycles. For example, fabrics that undergo cumulative washing and drying cycles tend to exhibit pilling over time, which is the formation of small balls of fabric on the surface of the fabric item, causing them to look dull and worn down. Such pilling is due to the repetitive mechanical forces of the laundry cycle, particularly as experienced in washing and drying machines. Color fading is also a problem due to the repeated exposure of the fabric to soaps and water in an agitated washing cycle, which breaks down fabrics and causes them to lose their color. Conventional fabric conditioning compositions are typically utilized during the rinsing or drying step of the washing cycle to minimize the effects of pilling and color fading. Many known fabric conditioning compositions provide some level of protection against pilling and color fading, but improved fabric conditioning compositions are needed that better protect fabrics and garments from wear out caused by cumulative laundry washes.

Further, many conventional fabric conditioning compositions may only be utilized during the rinsing or drying step due to their chemistry, requiring that they be separately added during a particular step of the wash cycle. Some fabric conditioning compositions are not compatible with cold water used during some washing cycles, and many fabric conditioning compositions are not compatible with water having a high hardness value. As such, fabric conditioning compositions that may be added during the washing step at any water temperature, including relatively cold temperatures, and which can be used together with laundry detergents, are desired. Fabric conditioning compositions that are compatible with water having a high hardness value are also desired.

BRIEF SUMMARY

Accordingly, one aspect of the invention is directed to fabric conditioning compositions comprising an aminopolysiloxane (AmPS). The fabric conditioning compositions of the invention provide improved protection against pilling and color fading, may be used during the washing step of the laundry, are compatible with conventional laundry detergents, any may be used with colder water temperatures and water having higher hardness values. Another aspect of the invention is directed to fabric conditioning compositions that include at least one AmPS component and a synthetic wax emulsion that may be added to the rinsing step of the laundry cycle and which improve protection against pilling and color fading.

The invention provides an in-wash fabric conditioning composition which includes about 0.1-5 wt %, based upon the total weight of the in-wash fabric conditioning composition, of at least one aminopolysiloxane having a polysiloxane structure having a distribution of alkyl branches with aminofunctional groups and water, wherein the at least one aminopolysiloxane and water are prepared as a micro or macro emulsion.

The invention also provides an in-wash fabric conditioning composition which includes about 0.1-5 wt %, based upon the total weight of the in-wash fabric conditioning composition, of at least one aminopolysiloxane having a polysiloxane structure having a distribution of alkyl branches with aminofunctional groups, water, and at least one synthetic wax emulsion.

The invention is also directed to a method of forming an in-wash fabric conditioning composition, which includes the steps of heating water to about 20-50° C., adding at least one aminopolysiloxane having a polysiloxane structure having a distribution of alkyl branches with aminofunctional groups to the water to form a mixture, and agitating the mixture at about 200-1,000 rpm for about 3-10 minutes.

DETAILED DESCRIPTION

In some embodiments, the present invention provides an in-wash fabric conditioning composition, comprising: from about 0.5 to about 40 wt % of an aminopolysiloxane comprising a polysiloxane core and a plurality of amino-substituted alkyl branches; and water, wherein the aminopolysiloxane and water form an emulsion.

In some embodiments, the in-wash fabric conditioning composition comprises from about 1 to about 35 wt % of the aminopolysiloxane. In other embodiments, the in-wash fabric conditioning composition comprises from about 5 to about 25 wt % of the aminopolysiloxane. Still further embodiments provide in-wash fabric conditioning composition comprising from about 7 to about 15 wt % of the aminopolysiloxane.

Some embodiments, provide in-wash fabric conditioning compositions comprising from about 0.5 to about 4 wt % of the aminopolysiloxane. Other embodiments provide in-wash fabric conditioning compositions comprising from about 1.0 to about 3.5 wt % of the aminopolysiloxane. While other embodiments provide in-wash fabric conditioning compositions comprising from about 1.5 to about 2.5 wt % of the aminopolysiloxane.

As used herein, "wt %" refers to a percentage calculated on the basis of the total weight of the in-wash fabric conditioning composition.

In some embodiments, the terms "fabric conditioning composition", in-wash fabric conditioning composition", and the like, are used interchangeably.

In some embodiments, the in-wash fabric conditioning composition comprises a total active content of from about 10 to about 35 wt %, of the in-wash fabric conditioning composition.

In some embodiments, the in-wash fabric conditioning composition has a pH of from about 3 to about 8. In some embodiments, pH is measured at 20° C.

In other embodiments, the in-wash fabric conditioning composition comprises from about 75 to about 95 wt % water.

In further embodiments, the in-wash fabric conditioning composition comprises a plurality of aminopolysiloxanes, wherein the first aminopolysiloxane has a different solids content than the second aminopolysiloxane.

Still further embodiments, provide in-wash fabric conditioning compositions comprising a first aminopolysiloxane and a second aminopolysiloxane. In some embodiments, the first aminopolysilane comprises a solids content of from about 1% to about 20%. In some embodiments, the first aminopolysilane comprises a solids content of from about 5% to about 15%. In some embodiments, the first aminopolysilane comprises a solids content of about 10%

In some embodiments, the second aminopolysiloxane comprises a solids content of from about 20% to about 50%. In other embodiments, the second aminopolysiloxane comprises a solids content of from about 25% to about 45%. In other embodiments, the second aminopolysiloxane comprises a solids content of from about 30% to about 40%. In other embodiments, the second aminopolysiloxane comprises a solids content of 35%.

In some embodiments, the present invention provides in-wash fabric conditioning compositions comprising from about 1 to about 40 wt % of the first aminopolysiloxane. In some embodiments, the present invention provides in-wash fabric conditioning compositions comprising from about 5 to about 35 wt % of the first aminopolysiloxane. In some embodiments, the present invention provides in-wash fabric conditioning compositions comprising from about 10 to about 30 wt % of the first aminopolysiloxane. In some embodiments, the present invention provides in-wash fabric conditioning compositions comprising about 10 wt %, 20 wt % or 30 wt % of the first aminopolysiloxane. Still other embodiments provide in-wash fabric conditioning compositions comprising from about 1 to about 20 wt % of the second aminopolysiloxane. While other embodiments provide in-wash fabric conditioning compositions comprising from about 5 to about 15 wt % of the second aminopolysiloxane. Some embodiments provide in-wash fabric conditioning compositions comprising about 5 wt %, 7 wt % or 10 wt % of the second aminopolysiloxane.

In some embodiments, the in-wash fabric conditioning composition further comprises from about 0.001 to about 0.1 wt % of an acidifying agent, based upon the total weight of the in-wash fabric conditioning composition. In some embodiments, the acidifying agent comprises citric acid, lactic acid, or a combination thereof. In other embodiments, the acidifying agent is present in an amount effective to maintain the pH of the in-wash fabric conditioning composition in a range of from about 3 to about 5.

In some embodiments, the in-wash fabric conditioning composition further comprises from about 0.01 to about 0.5 wt % of a chelating agent, based upon the total weight of the in-wash fabric conditioning composition. In some embodiments, the chelating agent comprises phosphonic acid. In some embodiments, the chelating agent may be amino tris methylene phosphonic acid. In some embodiments, the chelating agent reduces the effect of the salts in the water supplied during the laundry cycle.

In some embodiments, the in-wash fabric conditioning compositions further comprise a fragrance. In some embodiments, the fragrance comprises a combination of an organic fragrance oil and a slurry of capsules containing an organic fragrance oil. If present, the fragrance composition may be included in a ratio of 0.5:1, 1:0.5, 1:1, 2:0.5, 0.5:2, 1:3, or 3:1, based upon total weight of the fabric conditioning composition. Such fragrance capsules may be formed of a friable wall that releases an oil fragrance when broken by the agitation forces (e.g., rubbing, pressing) of the washing cycle, once the aqueous solvent media is eliminated. Examples of commercially available fragrance capsules that may be utilized with the fabric conditioning composition of the invention include those supplied by Firmenich Inc. (Plainsboro, NR), International Flavors and Fragrances Inc. (New York, N.Y.), and Givaudan (Vernier, Switzerland).

In some embodiments, the in-wash fabric conditioning compositions of the present invention further comprise a preservative. In some embodiments, the preservative comprises a mixture of isothiazolone compounds. In some embodiments, the preservative is present in an amount effective to increase the fabric conditioning composition's stability against microorganisms.

In some embodiments, the in-wash fabric conditioning compositions further comprise a colorant. In some embodiments, the colorant is water-soluble, for example, those commercialized by Milliken & Company (Spartanburg, S.C.) under the brand name Liquitint®.

In some embodiments, the emulsion further comprises a wax. In some embodiments, the wax is a synthetic wax.

Still further embodiments provide an in-wash fabric conditioning composition, comprising: an emulsion comprising: from about 0.1 to about 5 wt % of an aminopolysiloxane, based upon the total weight of the in-wash fabric conditioning composition, wherein the aminopolysiloxane comprises amino substituted alkyl moieties; an effective amount of a solvent; and a synthetic wax. In some embodiments, the synthetic wax is provided in the form of an emulsion. In some embodiments, the emulsion further comprises a blend of olefins and a cationic surfactant.

In some embodiments, the solvent is present in an amount effective to produce an emulsion with the aminopolysiloxane. In some embodiments, the solvent is water.

In some embodiments, the in-wash fabric conditioning compositions disclosed herein comprise, at a minimum, a mixture of at least one type of aminopolysiloxane (AmPS) as the main component and water. In other embodiments, the fabric conditioning compositions may further comprise additives that provide fragrance properties, stability against microorganisms, and which reduce the effect of high hardness of the water used during the washing step of the laundry cycle.

In some embodiments, the fabric conditioning compositions comprise at least one AmPS component prepared in a micro emulsion or macro emulsion with water. In some embodiments, the AmPS has a polysiloxane structure from which a distribution of alkyl branches with aminofunctional groups is constructed. This allows the AmPS to form particles with a broad size distribution that facilitates the preparation of micro or macro emulsions in water. Preparing the fabric conditioning compositions in the form of an emulsion allows them to be transparent or opaque, such that different colors can be added to make them more appealing to consumers.

In some embodiments, the AmPS can be used to prepare stable emulsions in water with a total active content of 10-35% of AmPS and with pH values of 3.0 to 7.90 at 20° C. The water content of the fabric conditioning composition is generally from about 70 to about 95 wt %, and may be from about 75 to about 95 wt %, based upon the total weight of the fabric conditioning composition. In this way, the fabric conditioning compositions of the invention may be used during the washing step of the laundry cycle, thereby eliminating the need for an additional rinse step and an automatic fabric softening dispensing system.

It is believed that the combination of cationic groups and a hydrophobic siloxane chain in the AmPS promotes its deposition on the fibers of the fabric, which reduces friction and mechanical damage caused during the washing step of the laundry cycle. As the number of wash cycles that a fabric has been exposed to increases, the damage due to excessive friction and mechanic forces also increases, which increases pilling build-up and color fading. By attaching itself to the fiber matrix, the AmPS used in certain embodiments of the present invention form a layer or barrier that reduces friction, thus reducing the number of fibers that are pulled out of the matrix pattern or are broken in such a way that pilling results. At the same time, this conservation of the fiber matrix maintains the original color of the fibers for a longer period of time since they remain intact better than with traditional fabric conditioning compositions. Further, the composition of the AmPS is such that it creates a balance of AmPS material deposited on the fabric and subsequently removed in each cumulative washing cycle, thus extending its life over cumulative uses. Lastly, another benefit provided by the AmPS is that the particular siloxane chains improve softness of the fabric by attaching themselves to the fabric's fibers.

As set forth above, the fabric conditioning compositions of the invention may further comprise at least one additive to achieve a variety of functions. In one embodiment, the fabric conditioning composition includes about 0.01-0.1 wt %, preferably about 0.03-0.07 wt %, based upon the total weight of the fabric conditioning composition.

In some embodiments, the AmPS emulsions comprise from about 30 to about 35% active ingredient and about 10 to about 20% of a cationic surfactant. In some embodiments, the at least one synthetic wax emulsion consists of a blend of olefins that are added at a level of about 25-36% as active matter and a cationic surfactant that maintains a stable dispersion in water.

Examples of suitable synthetic wax emulsions include, for example, those commercialized by BASF Corp. (Florham Park, N.J.) under the brand name Planatex HCC® or Planatex LLE®.

To form a stable dispersion, these fabric conditioning compositions may further comprise a thickener that promotes increased viscosity and reduced tendency to separate. Such thickeners may include, for example, those commercialized by SNF Floerger Group (Andrezieux, France) under the brand name Flosoft FS 200® or Flosoft 2833®.

In some embodiments, the fabric conditioning compositions of the present invention may be prepared as a liquid composition. For example, first, water is heated to about 20 to 50° C., more preferably about 35 to 45° C. The AmPS is then added to the heated water at the concentrations disclosed herein and agitated at from about 200 to about 1,000 rpm, preferably from about 500 to about 800 rpm, for from about 3 to about 10 minutes, preferably for from about 5 to about 8 minutes. To this liquid composition, a combination of optional fragrance oils and/or fragrance capsules may be added. The acid agent(s), chelating agent(s), and/or preservative agent(s) may also be added, keeping the agitation at from about 200 to about 1,000 rpm, preferably from about 500 to about 800 rpm, for from about 3 to about 15 minutes, preferably for from about 5 to about 10 minutes. The agitation provides a shear force that distributes the solids in the composition.

In an alternative embodiment, the shear force may be achieved using a system with standard baffling or static mixers. Standard baffling consists of four flat vertical plates, radially-directed (i.e., normal to the vessel wall), spaced at 90 degrees around the vessel periphery, and running the length of the vessel's straight side; standard baffle width is 1/10 or 1/12 of the vessel diameter (T/10 or T/12). In use, the fabric conditioning compositions of the invention are added to the laundry cycle at the beginning of the washing step in an amount of from about 15 to about 100 mL, preferably from about 25 to about 50 mL.

Embodiments of the present invention will now be further described by way of the following, non-limiting, examples.

EXAMPLES

Example 1

Six exemplary fabric conditioning compositions (Examples 1 to 6, or Ex. 1 to Ex. 6) comprising a combination of AmPS, water, and various additives are prepared according to the formulas set forth in Table 1 (below).

TABLE 1

| Ingredient | Ex. 1 | Ex. 2 | Ex. 3 | Ex. 4 | Ex. 5 | Ex. 6 |
|---|---|---|---|---|---|---|
| AmPS emulsion (10% solids) | 10 | — | 30 | — | 20 | 10 |
| AmPS emulsion (35% solids) | — | 10 | — | 7 | — | 5 |
| Lactic acid | 0.05 | 0.08 | 0.065 | — | — | — |
| Phosphonic acid | 0.1 | 0.05 | 0.08 | 0.1 | 0.05 | 0.08 |
| Water | 86.849 | 87.869 | 68.354 | 90.399 | 75.949 | 80.919 |
| QS (colorant, fragrance) | 3.001 | 2.001 | 1.501 | 2.501 | 4.001 | 4.001 |
| Total | 100 | 100 | 100 | 100 | 100 | 100 |

Examples 1 to 6 are prepared by heating water to a temperature of from about 20° C. to about 50° C., and then adding the AmPS emulsion at an agitation level of from about 500 to 1,000 rpm for from about 5 minutes to about 10 minutes using a double paddle agitator. Free oil fragrance and a slurry of fragrance capsules are then added, while maintaining the agitation at from about 500 rpm to about 1,000 rpm for from about 5 minutes to about 15 minutes. The remainder of the components set forth in Table 1 are then added, while maintaining the agitation at from about 600 rpm to about 1,000 rpm for from about 5 minutes to about 10 minutes.

Each of the exemplary fabric conditioning compositions is then added to a washing machine along with fabric samples at the beginning of the washing step according to the dosages set forth in Table 2 (below); and evaluated for protection against pilling and color fading throughout full laundry cycles (i.e., washing, rinsing, centrifugation, and drying).

TABLE 2

| | Ex. 1 | Ex. 2 | Ex. 3 | Ex. 4 | Ex. 5 | Ex. 6 |
|---|---|---|---|---|---|---|
| Wash Cycle Dosage | 50 mL | 25 mL | 20 mL | 50 mL | 30 mL | 20 mL |

Once the fabric samples had completed 5, 10 and 20 laundry cycles, they are analyzed to determine the level of pilling and color fading. Softness is evaluated on towels after 1 laundry cycle. Pilling of swatches of acrylic and polyester fabrics is evaluated using a visual scale according to the ASTM D 3512 test method. According to this method, pilling is evaluated on a 1 to 5 scale, whereby a level "1" denotes severe pilling build-up and a level "5" denotes no pilling build-up. Two additional control samples are also evaluated: (1) a conventional fabric softening composition (5.9% active ingredient) at 100 mL ("LFS" in Tables 3 to 8 below); and (2) laundry detergent only.

Color conservation of swatches of dyed cotton shirts are evaluated with a Hunter Lab UltraScan PRO spectrophotometer (Hunter Associates Laboratory, Inc., Reston, Va., United States) to measure the ΔE value, which indicates conservation of original color. The lower the ΔE value, the better color conservation is exhibited. Two additional control samples are also evaluated: (1) a conventional fabric softening composition (5.9% active ingredient) at 100 mL ("LFS" in Tables 3 to 8 below); and (2) laundry detergent only.

Softness of two groups of Terry towels (100% cotton) is evaluated according to a defined statistical model. According to this model, treated towels are presented to a group of untrained panelists, who select the towels that they perceive as being softest. The statistic model also takes into account whether the perception is significantly different between the two groups of towels presented, one treated with Examples 1-6, and the other treated only with a conventional fabric softening composition (5.9% active ingredient) at 100 mL ("LFS" in Tables 3 to 8 below). The results of each of the tests for each of the exemplary fabric conditioning compositions—Examples 1-6—are set forth in Tables 3 to 8 (below).

TABLE 3

Test Results for Example 1

| Evaluation | New In-Wash Composition | LFS (5.9% A.I.) | Detergent only |
|---|---|---|---|
| Pilling protection | 5 treat = 4<br>10 treat = 3.5<br>20 treat = 2.5 | 5 treat = 4<br>10 treat = 2<br>20 treat = 1 | 5 treat = 4<br>10 treat = 1.5<br>20 treat = 1 |
| Color conservation (ΔE*) | 5 treat = 1.0<br>10 treat = 3.45<br>20 treat = 6.45 | 5 treat = 1.5<br>10 treat = 9.43<br>20 treat = 11.52 | 5 treat = 1.5<br>10 treat = 11.44<br>20 treat = 13.76 |
| Softness benefit | Significantly better than detergent only | Significant better than detergent only | — |

TABLE 4

Test Results for Example 2

| Evaluation | New In-Wash Composition | LFS (5.9% A.I.) | Detergent only |
|---|---|---|---|
| Pilling protection | 5 treat = 5<br>10 treat = 4<br>20 treat = 3 | 5 treat = 4<br>10 treat = 2<br>20 treat = 1 | 5 treat = 4<br>10 treat = 1.5<br>20 treat = 1 |
| Color conservation (ΔE*) | 5 treat = 1.04<br>10 treat = 2.88<br>20 treat = 5.76 | 5 treat = 1.51<br>10 treat = 9.40<br>20 treat = 11.42 | 5 treat = 1.5<br>10 treat = 11.21<br>20 treat = 13.55 |
| Softness benefit | Significantly better than detergent only | Significantly better than detergent only | — |

TABLE 5

Test Results for Example 3

| Evaluation | New In-Wash Composition | LFS (5.9% A.I.) | Detergent only |
|---|---|---|---|
| Pilling protection | 5 treat = 4.5<br>10 treat = 4<br>20 treat = 2.5 | 5 treat = 4<br>10 treat = 2<br>20 treat = 1 | 5 treat = 4<br>10 treat = 1.5<br>20 treat = 1 |
| Color conservation (ΔE*) | 5 treat = 1.07<br>10 treat = 3.11<br>20 treat = 6.05 | 5 treat = 1.51<br>10 treat = 9.40<br>20 treat = 11.42 | 5 treat = 1.5<br>10 treat = 11.21<br>20 treat = 13.55 |
| Softness benefit | Significantly better than detergent only | Significantly better than detergent only | — |

TABLE 6

Test Results for Example 4

| Evaluation | New In-Wash Composition | LFS (5.9% A.I.) | Detergent only |
|---|---|---|---|
| Pilling protection | 5 treat = 4.5<br>10 treat = 3.5<br>20 treat = 2.5 | 5 treat = 4<br>10 treat = 2<br>20 treat = 1 | 5 treat = 4<br>10 treat = 1.5<br>20 treat = 1 |
| Color conservation (ΔE*) | 5 treat = 1.2<br>10 treat = 3.45<br>20 treat = 6.45 | 5 treat = 1.5<br>10 treat = 9.43<br>20 treat = 11.52 | 5 treat = 1.5<br>10 treat = 11.44<br>20 treat = 13.76 |
| Softness benefit | Significantly better than detergent only | Significantly better than detergent only | — |

TABLE 7

Test Results for Example 5

| Evaluation | New In-Wash Composition | LFS (5.9% A.I.) | Detergent only |
|---|---|---|---|
| Pilling protection | 5 treat = 4.5<br>10 treat = 3<br>20 treat = 2 | 5 treat = 4<br>10 treat = 2<br>20 treat = 1 | 5 treat = 4<br>10 treat = 1.5<br>20 treat = 1 |
| Color conservation (ΔE*) | 5 treat = 1.02<br>10 treat = 3.92<br>20 treat = 6.67 | 5 treat = 1.5<br>10 treat = 9.43<br>20 treat = 11.52 | 5 treat = 1.5<br>10 treat = 11.44<br>20 treat = 13.76 |
| Softness benefit | Significantly better than detergent only | Significantly better than detergent only | — |

TABLE 8

Test Results for Example 6

| Evaluation | New In-Wash Composition | LFS (5.9% A.I.) | Detergent only |
|---|---|---|---|
| Pilling protection | 5 treat = 4.5<br>10 treat = 3.5<br>20 treat = 3 | 5 treat = 4<br>10 treat = 2<br>20 treat = 1 | 5 treat = 4<br>10 treat = 1.5<br>20 treat = 1 |
| Color conservation (ΔE*) | 5 treat = 0.98<br>10 treat = 3.42<br>20 treat = 5.63 | 5 treat = 1.9<br>10 treat = 8.99<br>20 treat = 11.66 | 5 treat = 2.2<br>10 treat = 11.55<br>20 treat = 14.16 |
| Softness benefit | Significantly better than detergent only | Significantly better than detergent only | — |

As illustrated by the data described in Tables 3 to 8, all of the exemplary fabric conditioning compositions of the present invention—Examples 1 to 6—exhibited improved pilling protection, color conservation, and softness, over fabric samples treated only with a conventional fabric softener or with laundry detergent only. Example 6, which included a combination of two types of AmPS emulsions having varying solids contents, exhibited the best protection against pilling and color loss.

Example 2

Eight comparative fabric conditioning compositions (Comp. Ex. 1 to Comp. Ex. 8) are prepared according to the formulas set forth in Table 9 (below), each amount in weight percentage based upon total weight of the fabric conditioning composition. In this example, polysiloxane compositions (silicone emulsions) other than the AmPS used in certain embodiments of the present the invention are tested to determine their efficacy in reducing pilling and color fading and improving softness, after full laundry cycles (i.e., washing, rinsing, centrifugation, and drying).

TABLE 9

| Ingredient | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|
| Silicone emulsion FC110 ® (15% solids) | 10.0 | — | — | — | 30.0 | — | — | — |
| Silicone emulsion FC218 ® (15% solids) | | 10.0 | — | — | — | 30.0 | — | — |
| Silicone emulsion E101 ® + (20% solids) | — | — | 10.0 | — | — | — | 30.0 | — |
| Silicone emulsion Silpro AN35 ® + (20% solids) | — | — | — | 10.0 | — | — | — | 30.0 |
| Free oil fragrance | 2.0 | 2.0 | 2.0 | 2.0 | 0.5 | 0.5 | 0.5 | 0.5 |
| Slurry of fragrance capsules (40% solids) | 1.0 | 1.0 | 1.0 | 1.0 | 1.0 | 1.0 | 1.0 | 1.0 |
| Lactic acid (88% solids) | 0.05 | 0.05 | 0.05 | 0.05 | 0.065 | 0.065 | 0.065 | 0.065 |
| Phosphonic acid 88% solids | 0.1 | 0.1 | 0.1 | 0.1 | 0.08 | 0.08 | 0.08 | 0.08 |
| Colorant | 0.001 | 0.001 | 0.001 | 0.001 | 0.001 | 0.001 | 0.001 | 0.001 |
| Water | 86.849 | 86.849 | 86.849 | 86.849 | 68.354 | 68.354 | 68.354 | 68.354 |
| Total = | 100 | 100 | 100 | 100 | 100 | 100 | 100 | 100 |

Comp. Ex. 1 to Comp. Ex. 8 are prepared by heating water to a temperature of from about 20° C. to about 50° C., and then adding the various silicone emulsions at an agitation level of from about 500 to 1,000 rpm for from about 5 minutes to about 10 minutes using a double paddle agitator. Free oil fragrance and a slurry of fragrance capsules are then added, while maintaining the agitation at from about 500 rpm to about 1,000 rpm for from about 5 minutes to about 15 minutes. The remainder of the components set forth in Table 9 are then added, while maintaining the agitation at from about 600 rpm to about 1,000 rpm for from about 5 minutes to about 10 minutes.

Each of the comparative fabric conditioning compositions is then added to a washing machine along with fabric samples at the beginning of the washing step according to the following dosages: Comp. Ex. 1 to Comp. Ex. 4 are added in an amount of about 50 mL and Comp. Ex. 5 to Comp. Ex. 8 are added in an amount of about 30 mL.

Pilling, color conservation, and softness are then evaluated according to the parameters set forth in Example 1 (above), using the same reference compositions as controls. The results of each of the tests for each of the comparative fabric conditioning compositions are set forth in Table 10 (below). As can be seen, these compositions did not substantially improve pilling protection and color conservation over the traditional fabric softener composition (LFS) or detergent alone, and in some cases, they did not improve these properties at all. These results, when compared to the data described in Example 1 (above), underscore the unexpected benefits provided by the compositions of the present invention.

TABLE 10

| COMP. EX. 1 | Comp. Ex. 1 | LFS (5.9% A.I., 80 g added during rinse step) | Detergent only |
|---|---|---|---|
| Pilling protection | 5 treat = 4<br>10 treat = 2<br>20 treat = 1 | 5 treat = 4<br>10 treat = 2<br>20 treat = 1 | 5 treat = 4<br>10 treat = 1.5<br>20 treat = 1 |
| Color conservation (ΔE*) | 5 treat = 1.0<br>10 treat = 9.40<br>20 treat = 11.66 | 5 treat = 1.5<br>10 treat = 9.43<br>20 treat = 11.52 | 5 treat = 1.5<br>10 treat = 11.44<br>20 treat = 13.76 |
| Softness benefit | Significantly better than detergent only | Significantly better than detergent only | — |

| COMP. EX. 2 | Comp. Ex. 2 | LFS (5.9% A.I., 80 g added during rinse step) | Detergent only |
|---|---|---|---|
| Pilling protection | 5 treat = 4<br>10 treat = 2<br>20 treat = 1 | 5 treat = 4<br>10 treat = 2<br>20 treat = 1 | 5 treat = 4<br>10 treat = 1.5<br>20 treat = 1 |
| Color conservation (ΔE*) | 5 treat = 1.54<br>10 treat = 9.22<br>20 treat = 11.39 | 5 treat = 1.51<br>10 treat = 9.40<br>20 treat = 11.42 | 5 treat = 1.5<br>10 treat = 11.21<br>20 treat = 13.55 |
| Softness benefit | Significantly better than detergent only | Significantly better than detergent only | — |

TABLE 10-continued

| COMP. EX. 3 | Comp. Ex. 3 | LFS (5.9% A.I 80 g added during rinse step) | Detergent only |
|---|---|---|---|
| Pilling protection | 5 treat = 4<br>10 treat = 2<br>20 treat = 1 | 5 treat = 4<br>10 treat = 2<br>20 treat = 1 | 5 treat = 4<br>10 treat = 1.5<br>20 treat = 1 |
| Color conservation (ΔE*) | 5 treat = 1.49<br>10 treat = 9.37<br>20 treat = 11.44 | 5 treat = 1.51<br>10 treat = 9.40<br>20 treat = 11.42 | 5 treat = 1.5<br>10 treat = 11.21<br>20 treat = 13.55 |
| Softness benefit | Significantly better than detergent only | Significantly better than detergent only | — |

| COMP. EX. 4 | Comp. Ex. 4 | LFS (5.9% A.I., 80 g added during rinse step) | Detergent only |
|---|---|---|---|
| Pilling protection | 5 treat = 4.5<br>10 treat = 3.5<br>20 treat = 2.5 | 5 treat = 4<br>10 treat = 2<br>20 treat = 1 | 5 treat = 4<br>10 treat = 1.5<br>20 treat = 1 |
| Color conservation (ΔE*) | 5 treat = 1.2<br>10 treat = 3.45<br>20 treat = 6.45 | 5 treat = 1.5<br>10 treat = 9.43<br>20 treat = 11.52 | 5 treat = 1.5<br>10 treat = 11.44<br>20 treat = 13.76 |
| Softness benefit | Significantly better than detergent only | Significantly better than detergent only | — |

| COMP. EX. 5 | Comp. Ex. 5 | LFS (5.9% A.I., 80 g added during rinse step) | Detergent only |
|---|---|---|---|
| Pilling protection | 5 treat = 4.5<br>10 treat = 2<br>20 treat = 1 | 5 treat = 4<br>10 treat = 2<br>20 treat = 1 | 5 treat = 4<br>10 treat = 1.5<br>20 treat = 1 |
| Color conservation (ΔE*) | 5 treat = 1.47<br>10 treat = 9.36<br>20 treat = 11.27 | 5 treat = 1.5<br>10 treat = 9.43<br>20 treat = 11.52 | 5 treat = 1.5<br>10 treat = 11.44<br>20 treat = 13.76 |
| Softness benefit | Significantly better than detergent only | Significantly better than detergent only | — |

| COMP. EX. 6 | Comp. Ex. 6 | LFS (5.9% A.I., 80 g added during rinse step) | Detergent only |
|---|---|---|---|
| Pilling protection | 5 treat = 4.5<br>10 treat = 2<br>20 treat = 1 | 5 treat = 4<br>10 treat = 2<br>20 treat = 1 | 5 treat = 4<br>10 treat = 1.5<br>20 treat = 1 |
| Color conservation (ΔE*) | 5 treat = 1.88<br>10 treat = 8.89<br>20 treat = 11.60 | 5 treat = 1.9<br>10 treat = 8.99<br>20 treat = 11.66 | 5 treat = 2.2<br>10 treat = 11.55<br>20 treat = 14.16 |
| Softness benefit | Significantly better than detergent only | Significantly better than detergent only | — |

| COMP. EX. 7 | Comp. Ex. 7 | LFS (5.9% A.I., 80 g added during rinse step) | Detergent only |
|---|---|---|---|
| Pilling protection | 5 treat = 4<br>10 treat = 2<br>20 treat = 1 | 5 treat = 4<br>10 treat = 2<br>20 treat = 1 | 5 treat = 4<br>10 treat = 1.5<br>20 treat = 1 |
| Color conservation (ΔE*) | 5 treat = 1.96<br>10 treat = 9.16<br>20 treat = 11.50 | 5 treat = 1.95<br>10 treat = 9.12<br>20 treat = 11.54 | 5 treat = 2.4<br>10 treat = 11.75<br>20 treat = 14.36 |
| Softness benefit | Significantly better than detergent only | Significantly better than detergent only | — |

| COMP. EX. 8 | Comp. Ex. 8 | LFS (5.9% A.I., 80 g added during rinse step) | Detergent only |
|---|---|---|---|
| Pilling protection | 5 treat = 4<br>10 treat = 2<br>20 treat = 1 | 5 treat = 4<br>10 treat = 2<br>20 treat = 1 | 5 treat = 4<br>10 treat = 1.5<br>20 treat = 1 |
| Color conservation (ΔE*) | 5 treat = 1.89<br>10 treat = 9.10<br>20 treat = 11.09 | 5 treat = 1.91<br>10 treat = 9.09<br>20 treat = 11.21 | 5 treat = 2.6<br>10 treat = 11.39<br>20 treat = 14.01 |
| Softness benefit | Significantly better than detergent only | Significantly better than detergent only | — |

Example 3

A comparative fabric conditioning composition (Comp. Ex. 9) and five exemplary fabric conditioning compositions (Examples 7 to 11, or Ex. 7 to Ex. 11) comprising a combination of AmPS and/or a synthetic wax emulsion, as well as various additives, are prepared according to the formulas set forth in Table 11 (below).

TABLE 11

| Ingredient | Comp. Ex. 9 | Ex. 7 | Ex. 8 | Ex. 9 | Ex. 10 | Ex. 11 |
|---|---|---|---|---|---|---|
| Water | 97.95 | 94.95 | 94.95 | 91.95 | 94.95 | 94.95 |
| Oil fragrance/emulsion of fragrance capsules | 1.0/1.0 | 1.0/1.0 | 1.0/1.0 | 1.0/1.0 | 1.0/1.0 | 1.0/1.0 |
| Thickener | 0.05 | 0.05 | 0.05 | 0.05 | 0.05 | 0.05 |
| AmPS emulsion | 0.0 | 0.0 | 3.0 | 3.0 | 1.5 | 1.5 |
| Synthetic wax emulsion | 0.0 | 3.0 | 0.0 | 3.0 | 1.5 | 1.5 |

Each of the fabric conditioning compositions described in Table 11 (above) is added to a washing machine along with fabric samples at the beginning of the rinsing step, and each composition is then evaluated for protection against pilling and color fading throughout full laundry cycles (i.e., washing, rinsing, centrifugation, and drying).

Pilling is evaluated using the ASTM D3512 method as set forth in Example 1 (above). Color fading is also evaluated according to the parameters set forth in Example 1 (above). The results are set forth in Table 12 (below). These results demonstrate that the exemplary fabric conditioning compositions of the present invention, which include an AmPS emulsion, synthetic wax emulsion, or both (Ex. 7 to Ex. 11), exhibited better pilling protection and color conservation than a traditional fabric conditioning composition that contained neither of these components (Comp. Ex. 9).

TABLE 12

| | Comp. Ex. 9 | Ex. 7 | Ex. 8 | Ex. 9 | Ex. 10 | Ex. 11 |
|---|---|---|---|---|---|---|
| Pilling grade | 1 | 3.91 | 3.5 | 4.3 | 3 | 2.9 |
| ΔE | 20 | 8.48 | 9.2 | 7.996 | 13.24 | 14 |

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. An in-wash fabric conditioning composition, comprising:

an emulsion comprising:

from about 0.1 to about 5 wt % of an aminopolysiloxane, based upon the total weight of the in-wash fabric conditioning composition, wherein the aminopolysiloxane comprises amino substituted alkyl moieties;

an effective amount of a solvent;

a chelating agent comprising phosphonic acid;

a synthetic wax; and a blend of olefins and a cationic surfactant;

wherein pH of the in-wash fabric conditioning composition is in a range of from about 3 to about 5.

2. The in-wash fabric conditioning composition according to claim 1, wherein the solvent is present in an amount effective to produce an emulsion; optionally wherein the solvent is water.

3. The in-wash fabric conditioning composition according to claim 1, comprising from about 75 to about 95 wt % water as the solvent.

4. The in-wash fabric conditioning composition according to claim 1, further comprising from about 0.001 to about 0.1 wt % of an acidifying agent.

5. The in-wash fabric conditioning composition according to claim 4, wherein the acidifying agent comprises citric acid, lactic acid, or a combination thereof.

6. The in-wash fabric conditioning composition according to claim 1, further comprising a fragrance.

7. The in-wash fabric conditioning composition according to claim 6, wherein the fragrance comprises a combination of organic fragrance oil and a slurry of capsules containing an organic fragrance oil.

* * * * *